US007552685B2

(12) United States Patent
Frangos et al.

(10) Patent No.: US 7,552,685 B2
(45) Date of Patent: Jun. 30, 2009

(54) APPARATUS FOR SERVICING THE MAIN CABLE OF A SUSPENSION BRIDGE

(75) Inventors: Emanouel Frangos, Campbell, OH (US); Scott Silberman, New York, NY (US)

(73) Assignee: Easy Access Systems, Inc., Campbell, OH (US)

( * ) Notice: Subject to any disclaimer, the term of this patent is extended or adjusted under 35 U.S.C. 154(b) by 214 days.

(21) Appl. No.: 11/699,865

(22) Filed: Jan. 30, 2007

(65) Prior Publication Data

US 2008/0178760 A1 Jul. 31, 2008

(51) Int. Cl.
*B61B 7/00* (2006.01)
*B61B 12/04* (2006.01)

(52) U.S. Cl. ..... 104/112; 104/123

(58) Field of Classification Search ..... 104/112, 104/113, 114, 115, 116, 117, 117.1; 105/148, 105/149.1; 14/18; 182/36, 150
See application file for complete search history.

(56) References Cited

U.S. PATENT DOCUMENTS 3,237,718 A * 3/1966 Pearson ..... 182/36
3,702,124 A * 11/1972 Highland ..... 182/14
3,710,726 A * 1/1973 Buchholz et al. ..... 104/112
3,858,520 A * 1/1975 Patin ..... 104/89
3,945,462 A * 3/1976 Griswold ..... 182/150
4,069,765 A * 1/1978 Muller ..... 104/123
4,163,480 A * 8/1979 Highland ..... 182/14
4,234,055 A * 11/1980 Beeche ..... 182/142
4,253,548 A * 3/1981 Beeche ..... 182/142
D274,230 S * 6/1984 Kelly ..... D12/37
D274,320 S * 6/1984 Kelly ..... D12/37
4,478,312 A * 10/1984 Kurtgis ..... 182/142
4,641,587 A * 2/1987 Dalliard ..... 105/3
4,705,140 A * 11/1987 Dudley et al. ..... 182/3
4,882,998 A * 11/1989 Lipp ..... 104/112
5,570,638 A * 11/1996 Egli et al. ..... 104/173.1
6,189,455 B1 * 2/2001 Thompson ..... 104/112
6,817,444 B1 * 11/2004 Shinas ..... 182/150
2001/0037914 A1 * 11/2001 Preusser et al. ..... 182/150
2003/0000414 A1 * 1/2003 Sherman et al. ..... 104/112
2006/0131107 A1 * 6/2006 Duguay ..... 182/150
2008/0178760 A1 * 7/2008 Frangos et al. ..... 104/112
2008/0313825 A1 * 12/2008 Murakoshi et al. ..... 14/19

OTHER PUBLICATIONS

NCHRP, Inspection and Maintenance of Bridge Stay Cable Systems (Nov. 2005).*
NHRCP, Inspection and Maintenance of Cableway and Stay Systems, Nov. 2005.*

* cited by examiner

*Primary Examiner*—S. Joseph Morano
*Assistant Examiner*—Jason C Smith
(74) *Attorney, Agent, or Firm*—Robert J. Herberger

(57) ABSTRACT

A trolley travels in response to rotation of a winch along a main cable of a suspension bridge having a tower and support cables extending along and substantially parallel to the main cable. The trolley includes a support assembly engaged with the support cables, first and second enclosures suspended from the support assembly, each enclosure located at a laterally opposite side of the main cable, and a tugger cable engaged with the winch and connected to the support assembly for pulling the enclosures along the main cable toward the tower and/or allowing the enclosures to move along the main cable away from the tower.

18 Claims, 10 Drawing Sheets

APPARATUS FOR SERVICING THE MAIN CABLE OF A SUSPENSION BRIDGE

BACKGROUND OF THE INVENTION

1. Field of the Invention

The invention relates generally to a suspension bridge that spans the distance between anchorages and supports a roadway from main cables. More particularly it pertains to a trolley for traveling along the main cables.

2. Background

Suspension bridges are painted with engineered performance coatings that are developed to protect against corrosion and the elements. One of the more difficult items to paint is the main suspension cable of the bridge.

The main cables spans the distance between anchorages and supports a roadway from main cables, which are at least partially supported on towers spaced across the span. The main cables sweep upward from the roadway in arcs to an elevated location on the towers and return toward the roadway at the anchorages in another arc.

It is conventional for painters to traverse the main cables while applying primer and finish coats to protect the main cables from the elements. The height, length and inclination of the main cables make bridge painting time-consuming and dangerous.

There is a need in the industry for a safe, reliable system that sits atop the main cables, moves therealong, and transports equipment and workers, who are safely contained in enclosures. The system should provide unobstructed access to all outer surfaces of the main cables along their entire length. Preferably the system would significantly improve productivity of the workers.

SUMMARY OF THE INVENTION

An embodiment of this invention is a trolley that travels along the main cable of a suspension bridge in response to rotation of a tugger winch engaged with a cable, secured to the trolley. The trolley includes a support assembly engaged with support cables, first and second enclosures suspended from the support assembly, each enclosure located at a laterally opposite side of the main cable. The cable, which is connected to the support assembly, pulls the enclosures along the main cable toward the bridge tower and allows the enclosures to move along the main cable away from the tower as the cable unwinds from the winch.

An embodiment of the trolley applicable to bridges having its main cables arranged in parallel pairs at each lateral side of the bridge includes three enclosures, one enclosure located outboard of each of the main cables and an enclosure located between the main cables. Each of the three enclosures may be connected by a removable walkway to each of three enclosures that trail the leading enclosures and are, respectively, aligned with the leading enclosures.

Due to modular construction of the trolley, the walkways can be disconnected from the leading enclosures and trailing enclosures. It is another advantage of the trolley that the leading support assembly and leading enclosures can be disconnected from the trailing support assembly and trailing enclosures. Therefore, the trolley can be lightened for use by including only the leading support assembly and leading enclosures and disconnecting the walkways, trailing enclosures and trailing support assembly without compromising the trolley safety, stability or productivity of the operators.

The trolley is easy to disassemble and assemble, to install on the support cables and to connect to the tugger winch.

Use of the trolley in the operating environment has demonstrated a significant improve in productivity of the workers in comparison with that accomplished using conventional bridge painting suspension equipment.

The scope of applicability of the preferred embodiment will become apparent from the following detailed description, claims and drawings. It should be understood, that the description and specific examples, although indicating preferred embodiments of the invention, are given by way of illustration only. Various changes and modifications to the described embodiments and examples will become apparent to those skilled in the art.

DESCRIPTION OF THE DRAWINGS

These and other advantages will become readily apparent to those skilled in the art from the following detailed description of a preferred embodiment when considered in the light of the accompanying drawings in which.

DESCRIPTION OF THE PREFERRED EMBODIMENT

Figure 1:
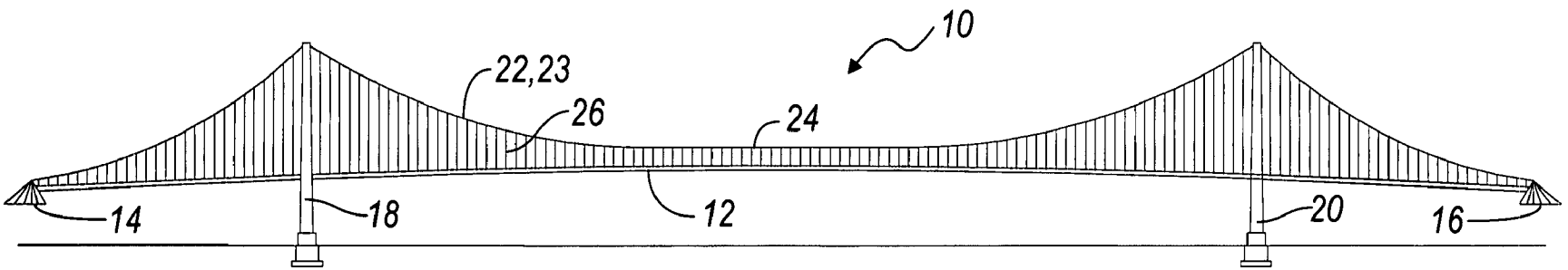
FIG. 1 PRIOR ART
FIG. 1 is a schematic diagram showing a side elevation of a suspension bridge.

FIG. 1 is a view of a suspension bridge 10 showing the roadway 12 spanning the distance between first and second anchorages 14, 16. Towers 18, 20 spaced along the roadway 12 support main cables 22, 23 which are suspended from the tops of the towers and extend downward, preferably in the form of a catenaries, toward the roadway 12 and anchorages 14, 16, where the main cables are secured. The main cables are arranged in pairs located above and at each side of the roadway 12, the inboard main cable 22 of each pair being located closer to the medial line of the roadway than the outboard main cable 23. Vertical suspender ropes 26, secured at each end to the main cables and roadway, support the roadway along the span between the towers and the anchorages. The mid-point 24 of the main span is located mid-way between the towers 18, 20.

Figure 2:
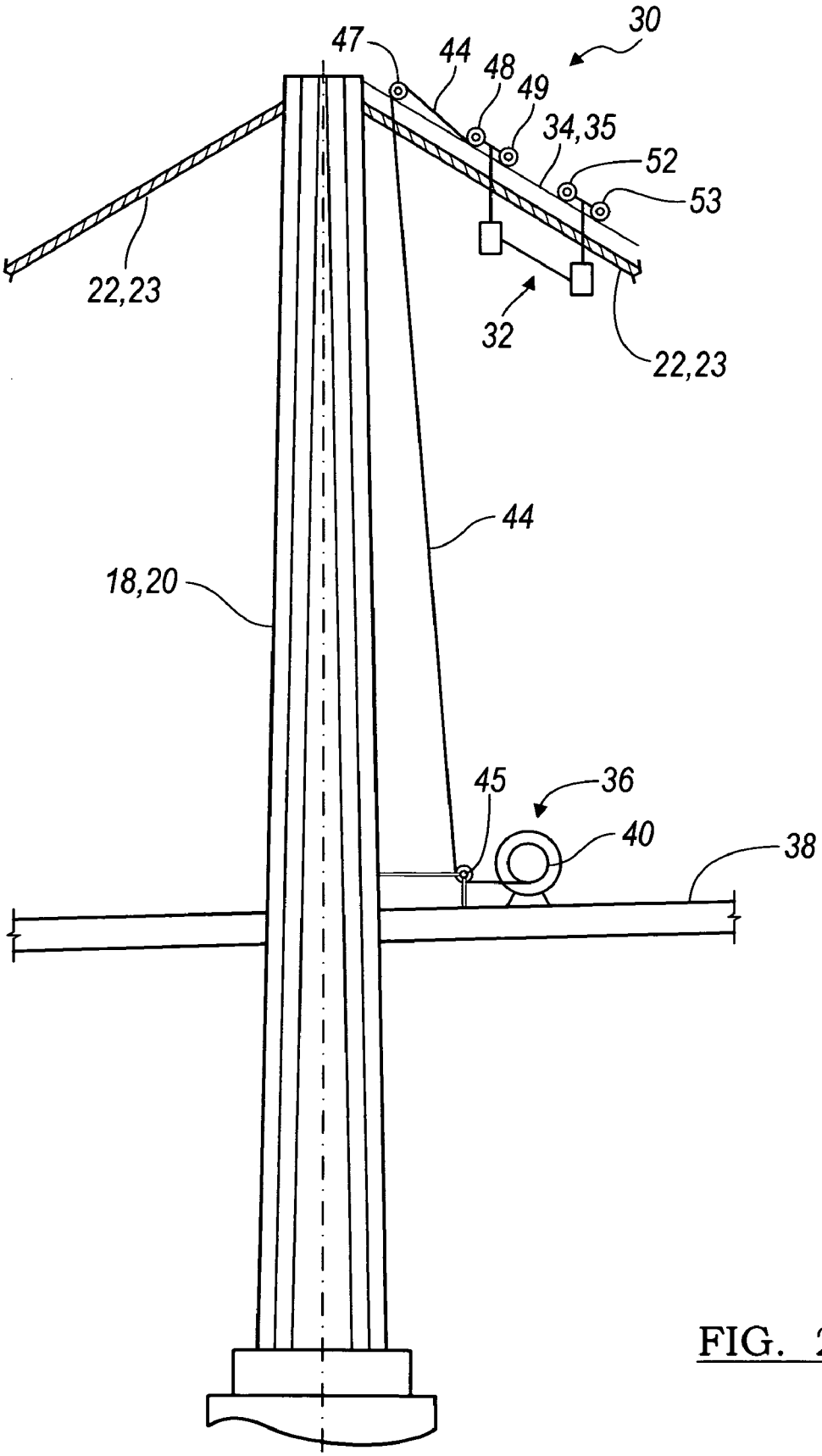
FIG. 2 is a side elevation view of a portion of a bridge tower near its upper extremity showing the main cables, hand ropes and trolley.
Figure 3:
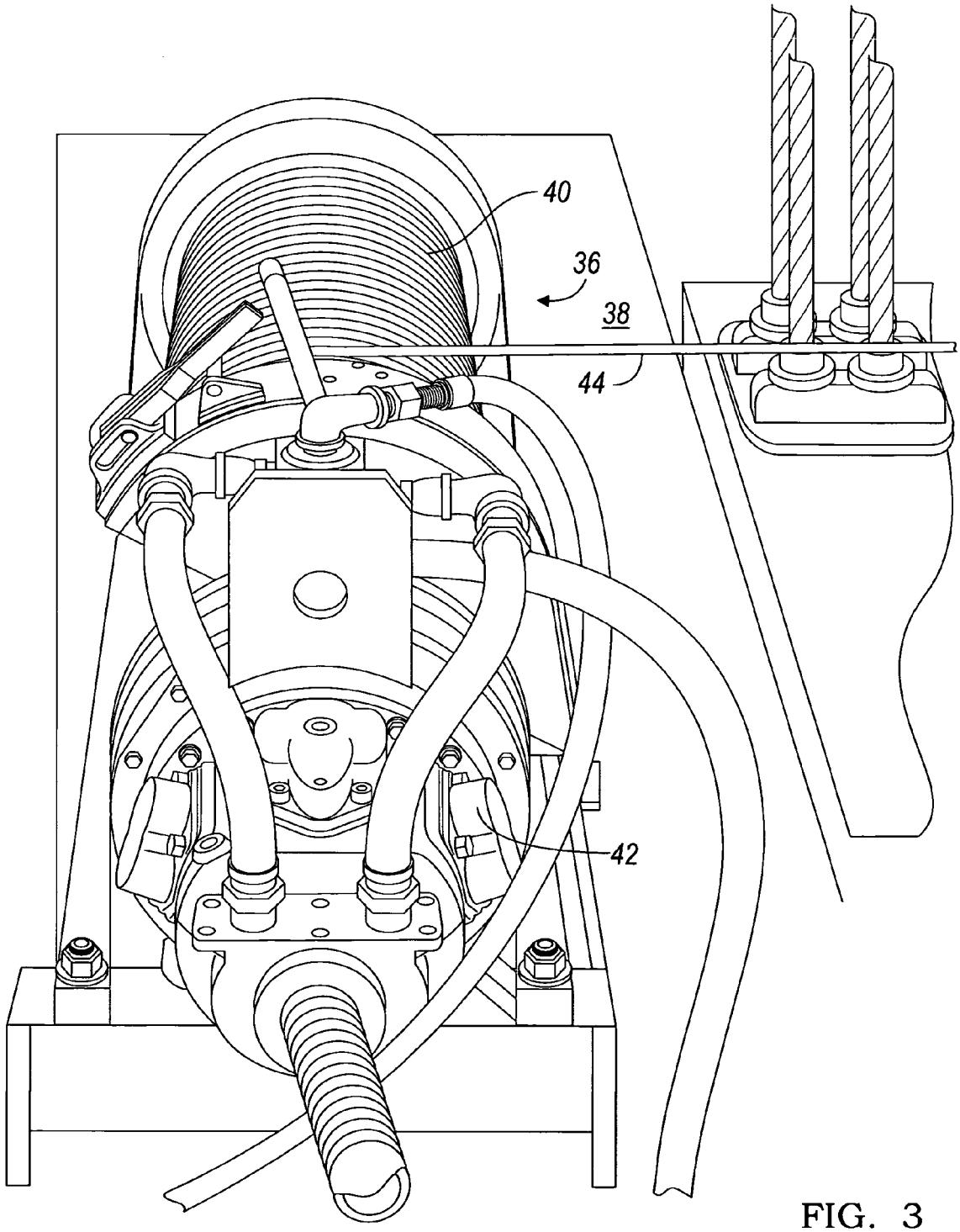
FIG. 3 is a top perspective view of the air tugger winch.

Refer now to FIGS. 2 and 3, FIG. 2 shows a portion of a system 30 for supporting and transporting a trolley 32 along support cables or hand ropes 34, 35, which are cables secured to the towers 18, 20, located above the main suspension cables 22, 23 and substantially parallel to the main cables 22, 23. The trolley system 30 includes an air tugger winch 36, supported on a tower truss 38. The winch 36 includes a cylindrical spindle 40, which is driven in rotation about the axis of the spindle by a power source 42, such as a compressor or engine that winds and unwinds a cable 44 on the spindle. The tugger cable 44 extends around a pulley 45, upward along a tower 18, 20, around a pulley 47 near the top of the tower, to the trolley 32, to which it is secured. The trolley 32 is supported by sheaves 48-49, 52-53 which ride on the support cables 34, 35, but its position and motion along the support cables 34, 35 is controlled by the wench winding and unwinding cable 44 around the surface of the spindle. By unwinding cable 44 from the spindle 40, the trolley 32 is lowered along the hand ropes 34, 35. By winding cable 44 around the surface of the spindle 40, the trolley 32 moves upward along the handrail cables. Turns in the path taken by cable 44 between spindle 40 and trolley 32 are accomplished by winding the cable around the anchored pulleys 45, 47.

The sheaves 48, 49 are wheels with a grooved rim like those used in a pulley block to guide the rope or cable. The tower truss 38 is a jointed structure having an open, built web construction arranged so that the frame is divided into a series of triangular figures.

Figure 4:
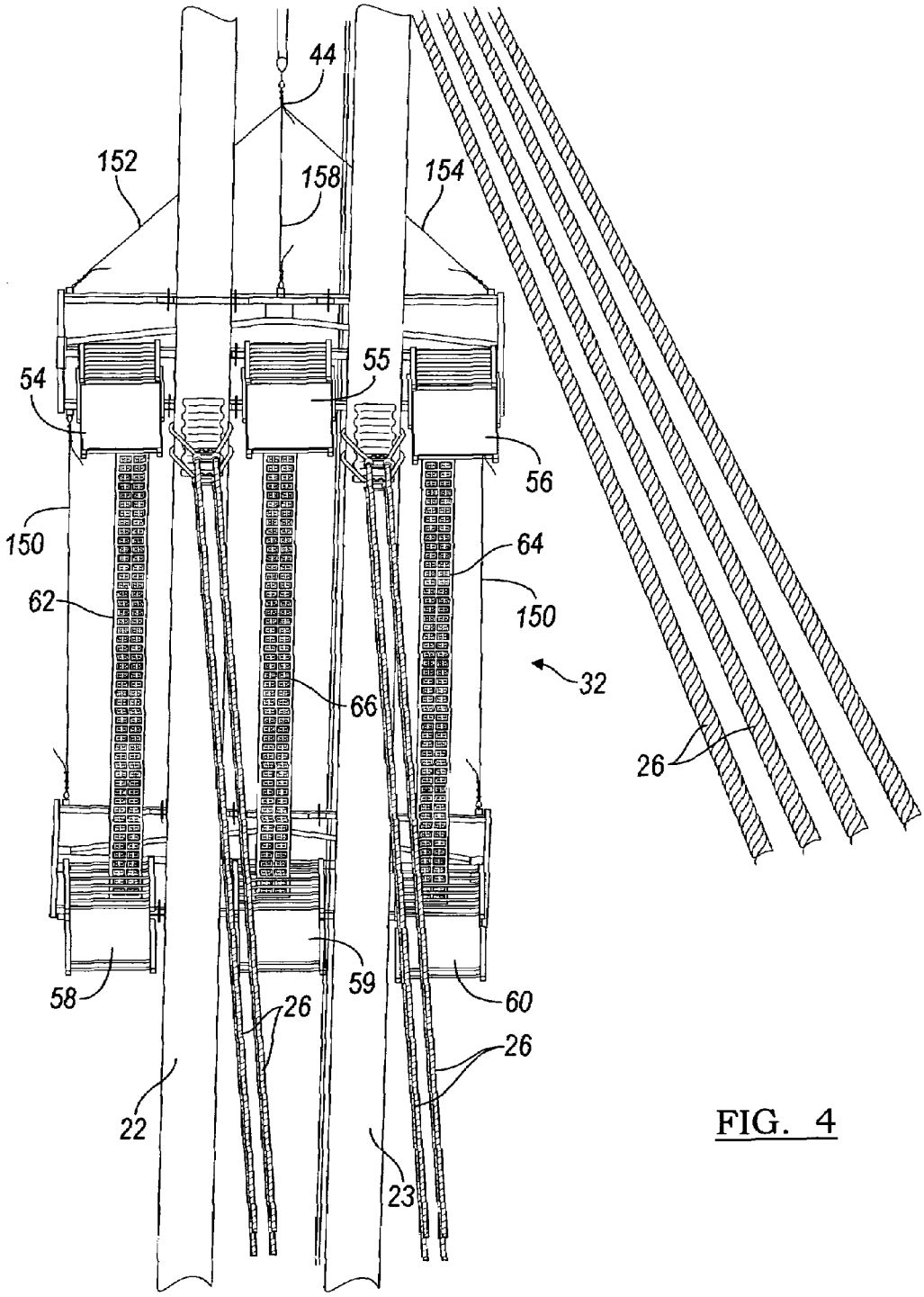
FIG. 4 is a bottom view looking upward toward the trolley and main cables of the bridge.

FIG. 4 illustrates the trolley 32 located near the main cables 22, 23, the suspender ropes 26 secured to the main cables, and cable 44 secured to the trolley. In one embodiment the trolley includes three leading enclosure 54, 55, 56; three trailing enclosures 58, 59, 60; an inboard platform 62 connecting the leading and trailing enclosures 54 and 58, which are located inboard of the inboard main cable 22; an outboard platform 64 connecting the outboard leading and trailing enclosures 56 and 60, which are located outboard of the outboard main cable 23; and an intermediate platform 66 connecting the intermediate enclosures 55 and 59, which are located between the main cable 22, 23. As FIG. 4 shows, the intermediate platform 66 and baskets 55, 59 are located between the main cables 22, 23 at each lateral side of the bridge.

Figure 5:
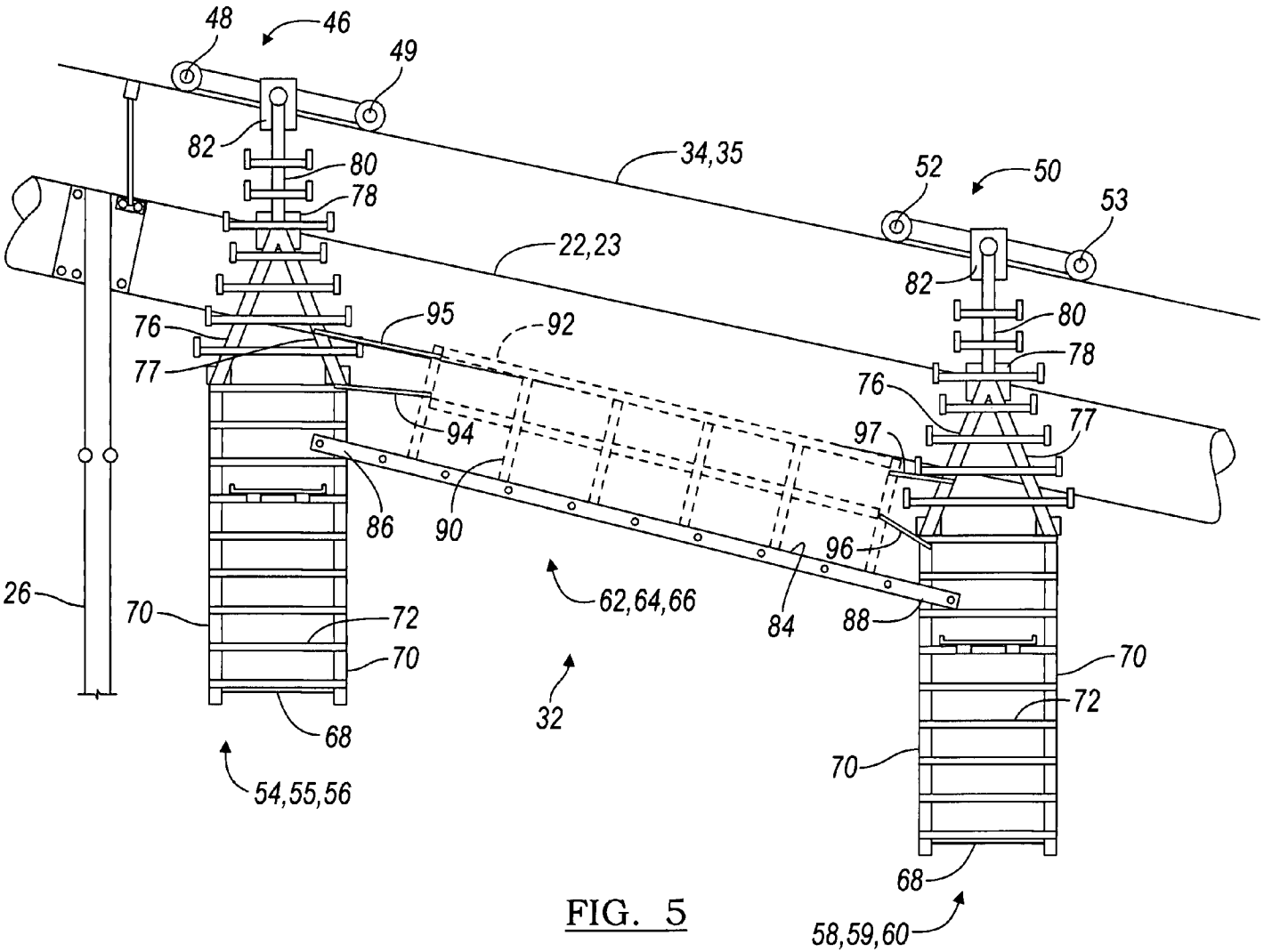
FIG. 5 is a side view of the trolley.

FIG. 5 shows the trolley 32 supported at a leading support assembly 46, which includes sheaves 48, 49 engaged with the hand ropes 34, 35, and a rear support assembly 50, which includes sheaves 52, 53. Alternatively, the platforms 62, 64, 66 and trailing enclosures 58-60 may be deleted to produce a lighter, but fully functional trolley 32.

Each enclosure 54-56, 58-60 comprises a welded frame enclosure that extends upward from the floor or plate 68, which supports an operator within the enclosure. Each enclosure is preferably square, approximately four feet on an edge, with each having a height of about nine feet and opened at its top. The corner of each enclosure has a vertical, hollow member 77 in the form of a square tube that extends vertically from the plate 66. Longitudinal members 72, spaced at approximately one-foot intervals at the sides of each enclosure, are welded to the vertical members 70. Similarly, lateral members 73, spaced at approximately at one-foot intervals at the front and rear of each enclosure, are welded to the vertical members 70.

The upper ends of the vertical supports 70 at the inboard and outboard sides of each enclosure are connected to inclined members 76, 77, which are secured by a gusset plate 78 to a vertical member 80, which is secured by a plate 82 to the leading and trailing support assemblies 46, 50, respectively.

Working platforms 62, 64, 66 each include a walkway 84, which is releasable secured at its upper end 86 to its respective leading enclosure 54-56. The platform is also releasable secured at its lower end 88 to the trailing enclosures 58-60. Each platform is formed with a framework 90, whose members extend upward from the walking surface 84 with a handrail 92 for use by the workers. At the upper of the platforms, cables 94, 95 connect the end of the framework 90 to the leading enclosures 54-56. At the lower end of the platforms, cables 96, 97 connect the framework 90 to the trailing enclosures 58-60.

Figure 7:
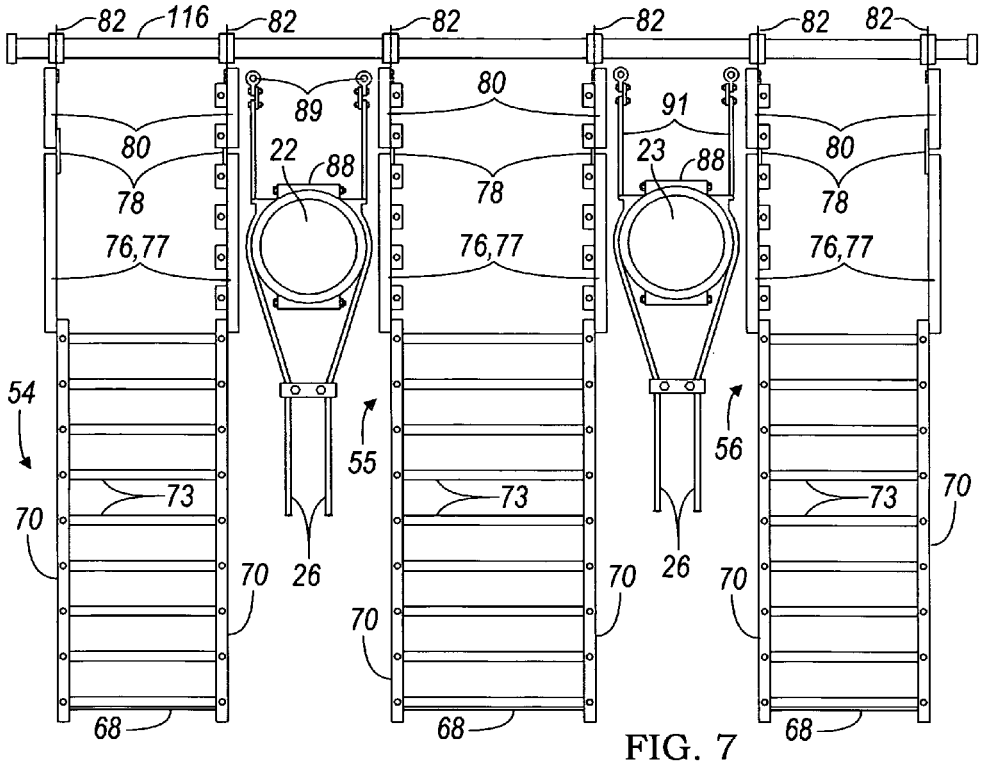
FIG. 7 is a front view showing the trolley straddling the main cables.
Figure 8:
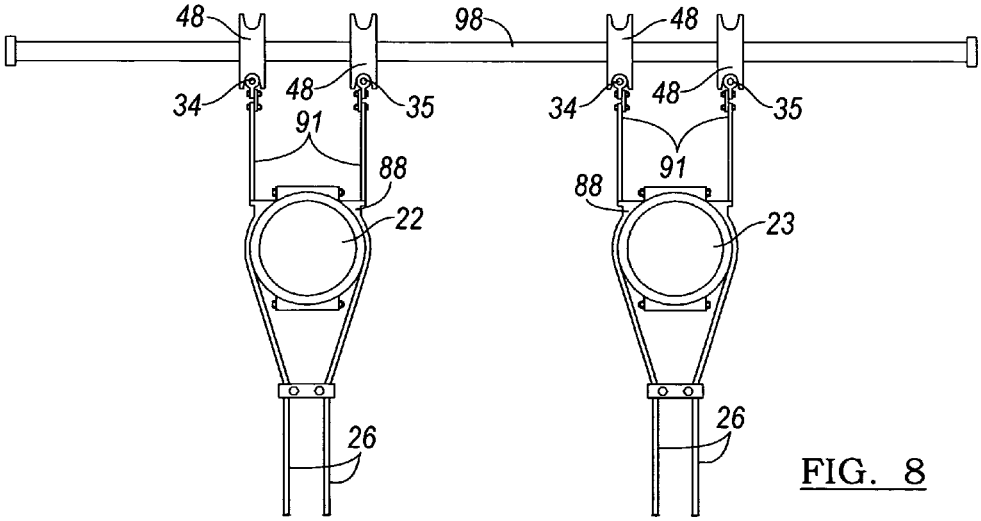
FIG. 8 is a front view of the trolley showing a portion of the support assembly engaged with the hand rail cables.

FIGS. 7 and 8 show the location of the main cables 22, 23 in relation to the enclosures 54-56, 58-60; suspender ropes 26 extending downward from the main cables 22, 23; a fitting 88 secured to the outer surface of the main cables; and vertical supports 91 extending upward from fitting 88 and formed with a loop or eyelet 89, through which the support cables 34, 35 pass. FIG. 8 shows the leading sheaves 48 of the leading support assembly 46 supported for rotation on a tube 98, which is another member of the support assemblies 46, 50.

Figure 9:
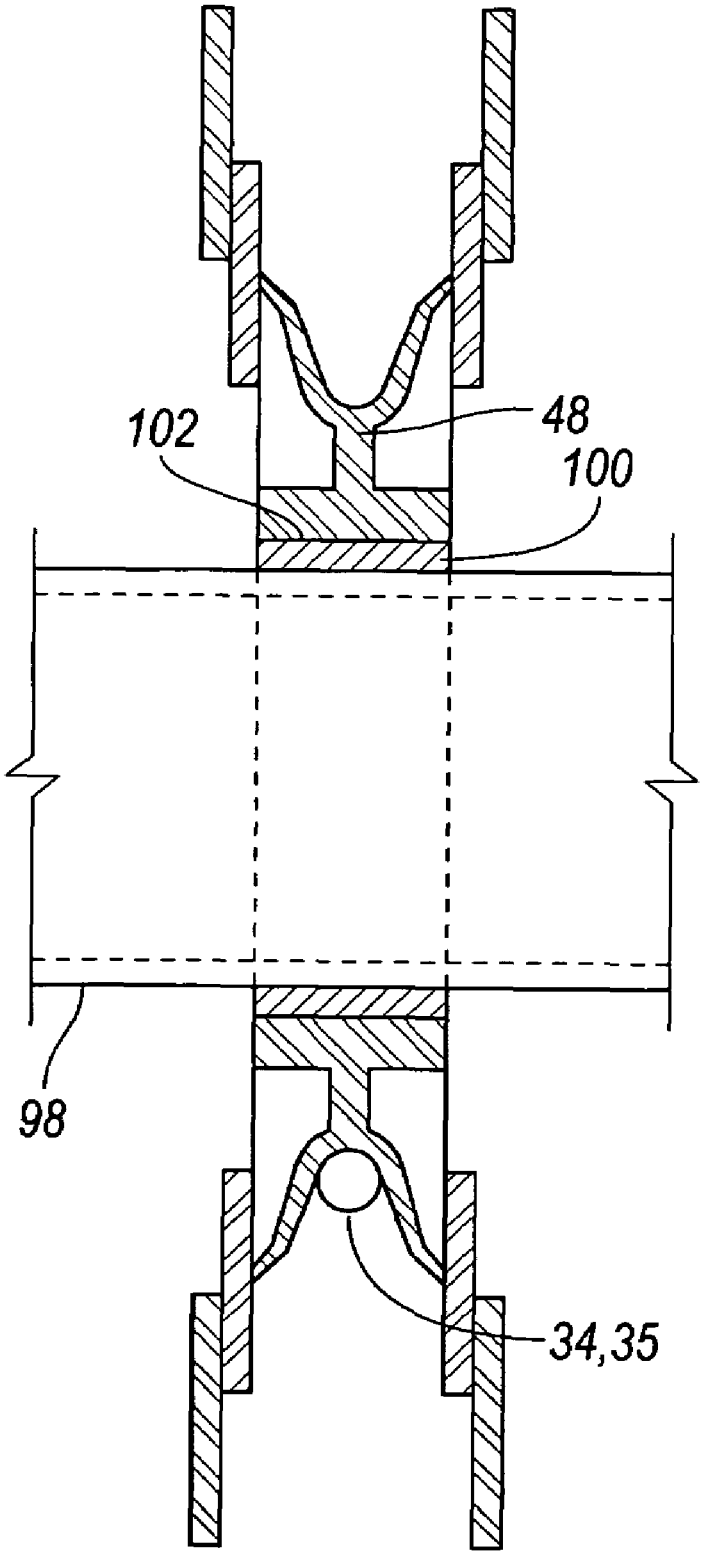
FIG. 9 is a front view partially in cross section showing a portion of the support assembly with its sheave carried on a hand rail cables.

FIG. 9 shows sheave 48 of the leading support assembly 46 supported for rotation on a lateral tube 98. A bronze bushing 100 is located over the outer surface of tube 98, and the hub 102 of sheave 48 is aligned with the bushing 100 and supported on one of the support cables 34, 35. The arrangement of FIG. 9 is typical for each of the other sheaves 49, 52, 53 of the leading and trailing support assemblies 46, 50.

Referring now to FIGS. 6A, 6B, 10 and 11, the leading trolley support assembly 46, which is substantially the same as the trailing support assembly 50, includes a beam 110 located at the inboard lateral side of the trolley 32 and a corresponding beam 112 located at the outboard side of the trolley. Extending between the beams 110, 112 are the leading tube 98 and trailing tube 114, each tube being secured at an opposite axial end to the beams 110, 112. A central tube 116 extends laterally between beams 110, 112 and is secured by each opposite end to the beams 110, 112, preferably by a weld.

Figure 6A:
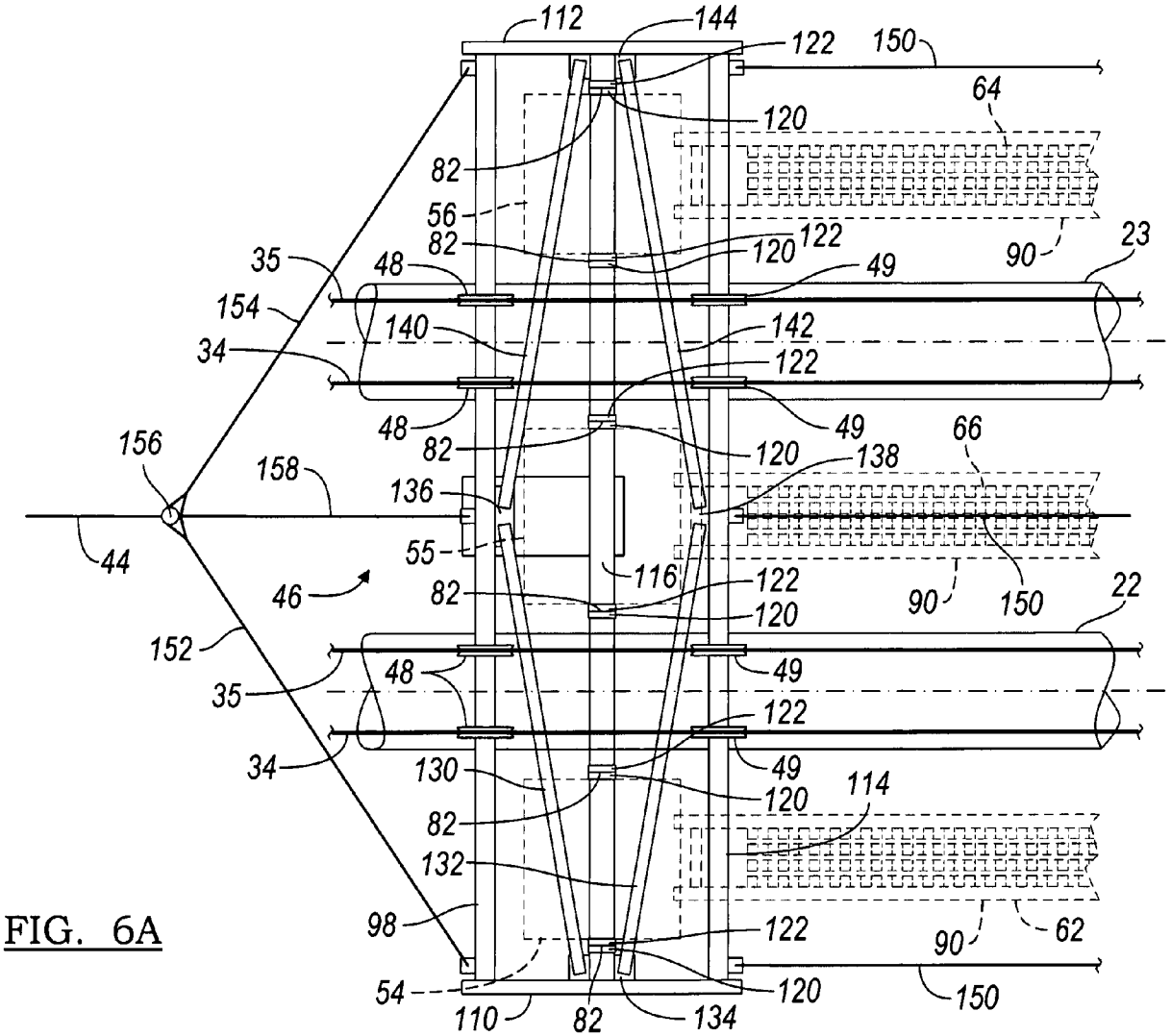
FIG. 6A is a top view of the leading portion of the trolley showing the leading support assembly.
Figure 6B:
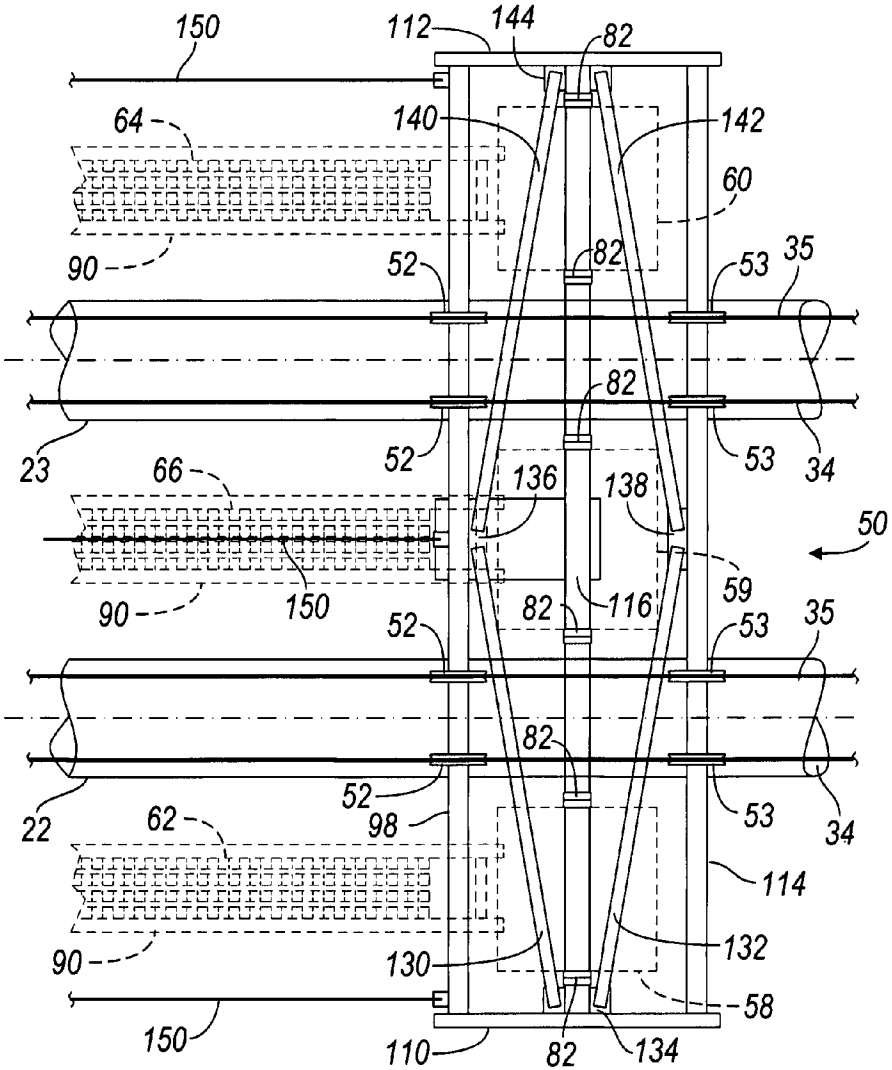
FIG. 6B is a top view of the trailing portion of the trolley of FIG. 6A showing the trailing support assembly.
Figure 10:
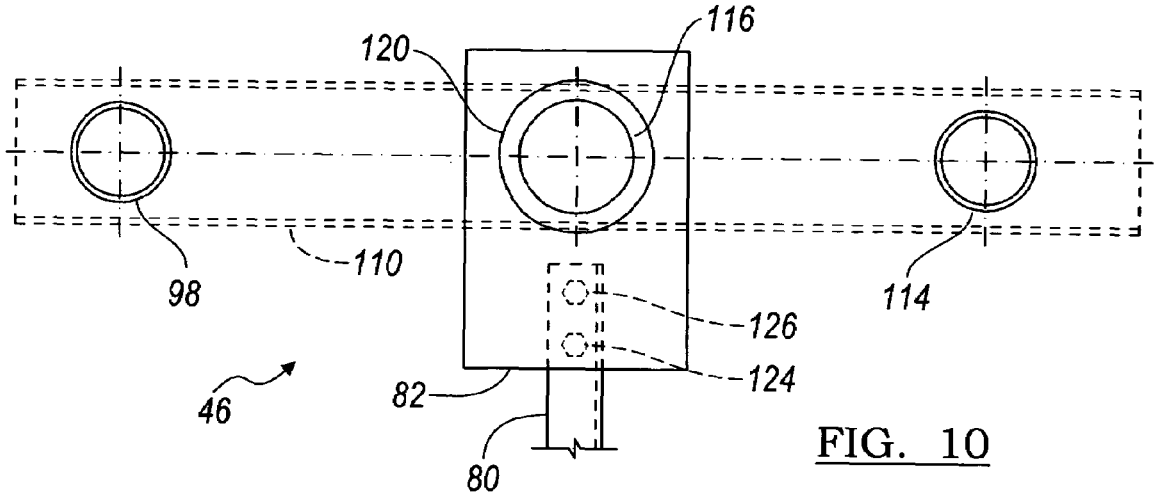
FIG. 10 is a side view of a trolley support assembly.
Figure 11:
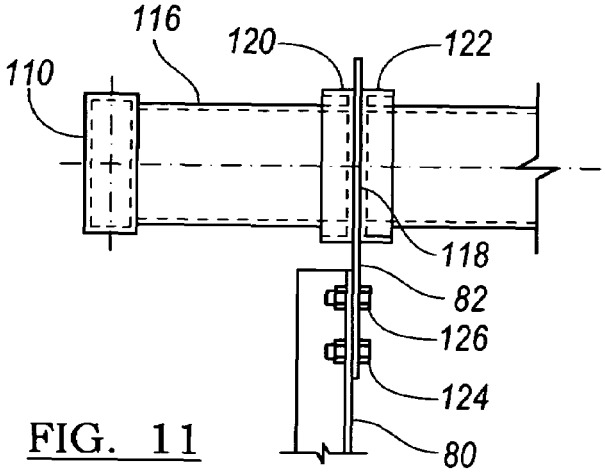
FIG. 11 is rear view of the support assembly of FIG. 10 showing the connection of the enclosures to the support assembly.

Further, FIG. 6A shows that each of the leading enclosures 54, 55, 56 is supported at each lateral side by the plate 82, which is secured to tube 116. Thus the three leading enclosures 54-56 are supported on tube 116 at six locations spaced along tube 116. Similarly, FIG. 6B shows that each of the trailing enclosures 58-60 is supported at each lateral side by the plate 82, which is secured to tube 116. Referring to FIGS. 10 and 11, a connection assembly, which includes angle 80 is secured by bolts 124, 126 at each of the six joints at which the enclosures are supported on tube 116. As FIGS. 10 and 11 show in detail, plate 82 is formed with a central opening that contacts the outer surface of tube 116. In this way, the weight of each enclosure is transmitted to tube 116. Two short tubes 120, 122 contact the lateral faces of plate 82, surround tube 116 and are welded at 118 to plate 82 and to the outer surface of tube 116. The short cylinders 120, 122 locate and secure the lateral position of plate 82 relative to tube 116.

As FIGS. 6A and 6B show, a stabilizing assembly includes angle members 130, 132, which extend diagonally from a gusset plate 134, secured to beam 110 and a lateral end of tube 116, to gusset plates 136, 138, which are secured to tubes 98, 114, respectively, near the mid points of tubes 98 and 114. Therefore, members 130, 132 are secured to gusset plates 134, 136 and 138. Similarly, angle members 140, 142 extend diagonally from gusset plates 136, 138, respectively, to a gusset plate 144, which is secured to beam 112 and a lateral end of tube 116. And, therefore, members 140, 142 are secured to gusset plates 136, 138 and 144. The angles 130, 132, 140, 142 provide structural continuity to the support assemblies 46, 50 and stabilize them against torsion and compression instability.

A cable 150 having a diameter of about one-half inch extends longitudinally and is connected at three lateral locations to the trailing side of tube 114 of the leading support assembly 46 and the leading side of tube 98 of the trailing support assembly 50.

Cables 152, 154 extend diagonally from the opposite axially ends of tube 98 of the leading support assembly 46 to a connection 156, where tugger cable 44 from the winch is secured. An additional cable 158 extends from connection 156 to the mid point of tube 98 of the leading support assembly 46.

The trolley 32 is used at each lateral side of the bridge to move along four catenaries shown in FIG. 1. The trolley 32 begins its ascent along main cables 22, 23 in a first path from the anchorage 14 to the top of tower 18. The trolley begins its ascent along the main cables in a second path from the mid-point 24 of the main span between the towers to the top of tower 18, and in a third path from the mid-point 24 of the main span between the towers to the top of tower 20. The trolley begins its ascent along the main cables in a fourth path from anchorage 16 to the top of tower 20. Then the procedure is repeated at the laterally opposite side of the bridge.

In operation, the sheaves 48-49, 52-53 of the leading and trailing support assemblies 46, 50 are placed on the hand rail cables 34, 35 as shown in FIGS. 6A and 6B. The enclosures 54-56, 58-60 and platforms 62, 64, 66 are located relative to the main cables 22, 23, as shown in FIG. 4. Then bolts 124, 126 are inserted into the angles 80 and plates 82 and nuts are engaged with the threads of the bolts, thereby completing a connection among the enclosures, platforms and support assemblies. Cable 44, which is engaged with the spool 40 of the tugger winch 36, is joined at connection 156 to the cables 152, 154, 158, which are secured to the leading support assembly 46. Cables 150 and platforms 90 provide structural continuity between the leading enclosures 54-56 and trailing enclosures 58-60. The power source 42 for the winch 36 rotates spool 40 causing cable 44 to wind around the spool and drawing trolley 32 along the main cables while the trolley is supported on the hand rail cables 34, 35.

If the trolley includes only the leading enclosures 54-56 and leading support assembly 46, the platforms 90 are disconnected from the leading enclosures 54-56 by removing the connecting bolts, and cables 150 are disconnected from tube 114 of the leading support assembly 46, thereby disconnecting trailing support assembly 50 from the leading support assembly. The modular construction and assembly of the trolley makes these changes easy to accomplish. The leading enclosures 54-56 are then supported on the hand rail cables 34, 35 at eight laterally and longitudinally spaced sheaves 48, 49, located on opposite lateral and longitudinal sides of the center of mass of the leading enclosures. This arrangement provides stable, reliable support for the workers and hardware carried on the trolley.

In accordance with the provisions of the patent statutes, the preferred embodiment has been described. However, it should be noted that other alternate embodiments can be practiced otherwise than as specifically illustrated and described.

What is claimed is:

1. A system for transporting a trolley along a first main cable of a suspension bridge having a tower, the system comprising:

first and second support cables, each support cable located above the first main cable and extending along and substantially parallel to the first main cable;

a trolley that includes lead and trail support assemblies engaged with the support cables, the lead support assembly having first and second enclosures suspended therefrom, each first and second enclosure located at a laterally opposite side of the first main cable, so that the first main cable is positioned between the first and second enclosures, the trail support assembly having third and fourth enclosures suspended therefrom, the third and fourth enclosures being spaced laterally with respect to the first main cable, so that the first main cable is positioned between the third and fourth enclosures, the third and fourth enclosures being spaced longitudinally from the first and second enclosure, and a first platform is secured to the first and third enclosures, and a second platform is secured is to the second and fourth enclosures;

a winch; and a tugger cable engaged with the winch and connected to the support assembly for pulling the enclosures along the first main cable toward the tower to service the first main cable.

2. The system of claim 1, wherein the winch is located at an elevation lower than an elevation of the trolley, the system further comprising:

pulleys defining a path for the tugger cable between the winch and the support assembly, each pulley providing a rotating surface on which the tugger cable turns around corners along the path.

3. The system of claim 1, wherein the support assembly includes:

a framework including sheaves engaged with the first and second support cables, connected to and located above the enclosures, and secured to the tugger cable, for transporting the enclosures along the support cables in response to rotation of the winch.

4. The system of claim 1, wherein the bridge includes a second main cable substantially parallel to and spaced laterally from the first main cable at a lateral side of a roadway supported by the bridge, the system further comprising:

third and fourth support cables, each support cable located above the second main cable and extending along and substantially parallel to the second main cable; and a fifth enclosure suspended from the support assembly, located adjacent the second main cable and at a laterally opposite side of the second main cable from the location of one of the first enclosure and the second enclosure, so that the second main cable is positioned between the fifth enclosure and said one of the first and second enclosures.

5. The system of claim 1, the bridge includes a second main cable substantially parallel to and spaced laterally from the first main cable at a lateral side of a roadway supported by the bridge, the system further comprising:

third and fourth support cables, each support cable located above the second main cable and extending along and substantially parallel to the second main cable;

a fifth enclosure suspended from the support assembly, located at a laterally opposite side of the second main cable from the location of one of the first enclosure and the second enclosure, so that the second main cable is positioned between the fifth enclosure and said one of the first and second enclosures; and a framework including sheaves engaged with first, second, third and fourth support cables, connected to and located above the enclosures, and secured to the tugger cable, for transporting the first, second and third enclosures along the support cables in response to rotation of the winch.

6. A trolley for traveling along a main cable of a suspension bridge having a tower and support cables extending along and substantially parallel to the main cable, the trolley comprising:

a support assembly engaged with the support cables having:

a first beam extending longitudinally and located at a first lateral side of the support assembly;

a second beam extending longitudinally and located at a second lateral side of the support assembly opposite the first side;

a first laterally extending tube located at a leading side of the support assembly and secured to the first beam and the second beam;

a second laterally extending tube located at a trailing side of the support assembly and secured to the first beam and the second beam;

a third laterally extending tube located between the first tube and the second tube and secured to the first beam and the second beam;

sheaves mutually spaced laterally and mounted for rotation on the first tube and the second tube, each sheave engageable with one of the support cables;

multiple connection assemblies, each connection assembly secured to one of the first enclosure, the second enclosure, and the third enclosure, and supported on the third tube; and a stabilizing frame having a first member secured to the first beam and third tube, with the first member extending diagonally and being secured to the first tube, a second member secured to the first beam and third tube, with the second member extending diagonally and being secured to the second tube, a third member secured to the second beam and third tube, with the third member extending diagonally and being secured to the first tube, and a fourth member secured to the second beam and third tube, with the fourth member extending diagonally and being secured to the second tube; and first and second enclosures suspended from the support assembly, each enclosure located at a laterally opposite side of the main cable;

a third enclosure suspended from the support assembly and spaced laterally from the first and second enclosures;

a winch; and a tugger cable engaged with the winch and connected to the support assembly for pulling the enclosures along the main cable toward the tower.

7. The trolley of claim 6, wherein at least one of the enclosures comprises:

a floor;

posts extending upright from the floor;

lateral members mutually spaced along and secured to at least two posts; and longitudinal members mutually spaced along and secured to at least two posts, said members and posts surrounding the enclosure and providing an opening above the floor.

8. The trolley of claim 6, wherein the support assembly further includes:

bearings supported on the frame; and wherein each sheave is mounted on one of the bearings and engaged with the first and second support cables, for transporting the enclosures along the support cables in response to rotation of the winch.

9. A trolley for traveling along first and second main cables of a suspension bridge having a tower, support cables extending along and substantially parallel to each of the main cables, the trolley comprising:

a leading support assembly engaged with the support cables;

first, second and third enclosures suspended from the leading support assembly and spaced laterally with respect to the main cables;

a trailing support assembly engaged with the support cables;

fourth, fifth and sixth enclosures suspended from the trailing support assembly, spaced laterally with respect to the main cables, and spaced longitudinally from the first, second and third enclosures; and first, second and third platforms, the first platform releasably secured to the first and fourth enclosures, the second platform releasably secured to the second and fifth enclosures, and the third platform releasably secured to the third and sixth enclosures; and a tugger cable connected to the leading support assembly for pulling the enclosures along the main cables.

10. The trolley of claim 9, wherein at least one of the enclosures comprises:

a floor;

posts extending upright from the floor;

lateral members mutually spaced along and secured to at least two posts; and longitudinal members mutually spaced along and secured to at least two posts, said members and posts surrounding the at least one enclosure and providing an opening above the floor.

11. The trolley of claim 9, wherein:

the leading support assembly further includes:

a first frame connected to and located above the first, second and third enclosures, and secured to the tugger cable;

first bearings supported on the first frame; and multiple first sheaves, each first sheave mounted on one of the first bearings and engaged with one of the support cables; and the trailing support assembly further includes:

a second frame connected to and located above the fourth, fifth and sixth enclosures;

second bearings supported on the second frame; and multiple second sheaves, each second sheave mounted on one of the second bearings and engaged with one of the support cables.

12. The trolley of claim 9, wherein the leading support assembly includes:

a first beam extending longitudinally and located at a first lateral side of the leading support assembly;

a second beam extending longitudinally and located at a second lateral side of the leading support assembly opposite the first side;

a first, laterally extending tube located at a leading side of the leading support assembly and secured to the first beam and the second beam;

a second, laterally extending tube located at a trailing side of the leading support assembly and secured to the first beam and the second beam;

a third, laterally extending tube located between the first tube and the second tube and secured to the first beam and the second beam;

first sheaves mutually spaced laterally and mounted for rotation on the first tube and the second tube, each first sheave engaged one of the support cables; and multiple connection assemblies, each connection assembly secured to one of the first, second and third enclosures and supported on the third tube.

13. The trolley of claim 12 further comprising a leading stabilizing frame including:

a first member secured to the first beam and third tube, extending diagonally, and secured to the first tube;

a second member secured to the first beam and third tube, and extending diagonally, and secured to the second tube;

a third member secured to the second beam and third tube, extending diagonally, and secured to the first tube; and a fourth member secured to the second beam and third tube, extending diagonally, and secured to the second tube.

14. The trolley of claim 9, wherein the trailing support assembly includes:

a third beam extending longitudinally and located at a first lateral side of the trailing support assembly;

a fourth beam extending longitudinally and located at a second lateral side of the trailing support assembly opposite the first side;

a fourth, laterally extending tube located at a leading side of the trailing support assembly and secured to the third beam and the fourth beam;

a fifth, laterally extending tube located at a trailing side of the trailing support assembly and secured to the third beam and the fourth beam;

a sixth, laterally extending tube located between the fourth tube and the fifth tube and secured to the third beam and the fourth beam;

second sheaves mutually spaced laterally and mounted for rotation on the fourth tube and the fifth tube, each second sheave engaged one of the support cables; and second connection assemblies, each second connection assembly secured to one of the fourth, fifth and sixth enclosures and supported on the sixth tube.

15. The trolley of claim 14 further comprising a trailing stabilizing frame including:

a fifth member secured to the third beam and sixth tube, extending diagonally, and secured to the fourth tube;

a sixth member secured to the third beam and sixth tube, and extending diagonally, and secured to the fifth tube;

a seventh member secured to the fourth beam and sixth tube, extending diagonally, and secured to the fourth tube; and an eighth member secured to the fourth beam and sixth tube, extending diagonally, and secured to the fifth tube.

16. The trolley of claim 9, wherein:

the first enclosure, fourth enclosure and first platform are located laterally adjacent the first main cable;

the second enclosure, fifth enclosure and second platform are located between the first and second main cables; and the third enclosure, sixth enclosure and third platform are located laterally adjacent the second main cable.

17. A system for transporting a trolley along a first main cable of a suspension bridge having a tower, the system comprising:

first and second support cables, each support cable located above the first main cable and extending along and substantially parallel to the first main cable;

a winch; and a tugger cable engaged with the winch and connected to a support assembly for pulling the first, second, third and fourth enclosures along the first main cable toward the tower; and p1 wherein the trolley includes the support assembly engaged with the support cables, the support assembly having a frame connected to and located above the enclosures, the trolley having bearings supported on the frame, and multiple sheaves, each sheave mounted on one of the bearings and engaged with the first and second support cables for transporting the enclosures along the support cables; and wherein the support assembly further includes:

a leading support assembly having the first and second enclosures suspended therefrom, the first and second enclosures being spaced on a laterally opposite side of the first main cable, so that the first main cable is positioned between the first and second enclosures;

a trailing support assembly having the third and fourth enclosures suspended therefrom, the third and fourth enclosures being spaced laterally with respect to the first main cable, so that the first main cable is positioned between the third and fourth enclosures, and wherein the third and fourth enclosures are spaced longitudinally from the first and second enclosures; and first and second platforms, the first platform releasably secured to the first and third enclosures, the second platform releasably secured to the second and fourth enclosures.

18. A system for transporting a trolley along first and second main cables of a suspension bridge having a tower, with support cables extending along and substantially parallel to each of the main cables, the system comprising:

a trolley having:

a leading support assembly engaged with the support cables;

first, second and third enclosures suspended from the leading support assembly and spaced laterally with respect to the main cables;

a trailing support assembly engaged with the support cables;

fourth, fifth and sixth enclosures suspended from the trailing support assembly, spaced laterally with respect to the main cables, and spaced longitudinally from the first, second and third enclosures; and first, second and third platforms, the first platform releasably secured to the first and fourth enclosures, the second platform releasably secured to the second and fifth enclosures, and the third platform releasably secured to the third and sixth enclosures; and a winch; and a tug cable engaged with the winch and connected to the support assembly for pulling the enclosures along the first and second main cables toward the tower to service the first and second main cables.

* * * * *